US010431949B2

(12) United States Patent
Lin

(10) Patent No.: US 10,431,949 B2
(45) Date of Patent: Oct. 1, 2019

(54) TERMINAL CONNECTOR PLIERS

(71) Applicant: JETOOL CORP., New Taipei (TW)

(72) Inventor: Kai-Yen Lin, New Taipei (TW)

(73) Assignee: JETOOL CORP., New Taipei (TW)

( * ) Notice: Subject to any disclaimer, the term of this patent is extended or adjusted under 35 U.S.C. 154(b) by 135 days.

(21) Appl. No.: 15/462,916

(22) Filed: Mar. 20, 2017

(65) Prior Publication Data

US 2017/0294752 A1 Oct. 12, 2017

(30) Foreign Application Priority Data

Apr. 11, 2016 (TW) ..... 105111198 A

(51) Int. Cl.

*H01R 43/042* (2006.01)
*H01R 43/05* (2006.01)
*H01R 43/027* (2006.01)
*H01R 43/28* (2006.01)

(52) U.S. Cl.

CPC ..... *H01R 43/0421* (2013.01); *H01R 43/027* (2013.01); *H01R 43/05* (2013.01); *H01R 43/28* (2013.01)

(58) Field of Classification Search

CPC .. H01R 43/0421; H01R 43/027; H01R 43/28; H01R 43/05

See application file for complete search history.

(56) References Cited

U.S. PATENT DOCUMENTS 5,109,591 A * 5/1992 Hung ..... B25B 7/22 29/33 M
5,168,592 A * 12/1992 Jee ..... B25B 7/12 7/107
5,992,002 A * 11/1999 Hung ..... H01R 43/0421 29/33 M
6,968,726 B2 * 11/2005 Wang ..... H01R 43/0421 29/566.4
2002/0056309 A1 * 5/2002 Beetz ..... B25B 7/12 72/409.16
2005/0086993 A1 * 4/2005 Wang ..... H01R 43/0421 72/409.16
2009/0044410 A1 * 2/2009 Battenfeld ..... H02G 1/1221 30/91.2

FOREIGN PATENT DOCUMENTS

JP 2009050152 A * 3/2009 ..... H02G 1/1221
TW 573857 1/2004

OTHER PUBLICATIONS

"Office Action of Taiwan Counterpart Application," dated Jul. 27, 2017, p. 1-p. 7.

* cited by examiner

*Primary Examiner* — Peter Dungba Vo
*Assistant Examiner* — Jeffrey T Carley
(74) *Attorney, Agent, or Firm* — JCIPRNET

(57) ABSTRACT

The present invention relates to a terminal connector pliers, where the terminal connector pliers crimp a cable to a connector housing to form a terminal connector, the connector housing and a plurality of signal wires of the cable are placed into a placement position of a through-hole, the terminal connector pliers enable the third linking body and the fourth linking body to actuate a crimping block to move toward the placement position by closing the first linking body and the second linking body in a pressing manner, and while a crimp connection is performed, the first primary knife and the first secondary knife smoothly trim the wires of the cable penetrating out of the through-hole.

5 Claims, 20 Drawing Sheets

TERMINAL CONNECTOR PLIERS

CROSS-REFERENCE TO RELATED APPLICATION

This application claims the priority benefit of Taiwan application serial no. 105111198, filed on Apr. 11, 2016. The entirety of the above-mentioned patent application is hereby incorporated by reference herein and made a part of this specification.

BACKGROUND OF THE INVENTION

1. Field of the Invention

The present disclosure generally relates to a terminal connector pliers for crimping a plurality of wires of a cable to a connector housing, in particular, a main body of the terminal connector pliers is provided with a through-hole, so that an unnecessary portions of the wires can penetrate out of the main body, and while a crimp connection is performed, the unnecessary portions of the wires penetrated out of the through-hole is smoothly trimmed and aligned with the connector housing.

2. Description of Related Art

Accordingly, a common computer network or telephone uses a cable perform linked transmission, in order to adapt to a telephone set or a socket of a computer, the cable is connected in a crimping manner to a connector at an end portion of the cable, so as to be plugged to the telephone set or the socket of the computer. Referring to FIG. 1 to FIG. 4, crimp connection work is performed on a signal wire 110 and a connector housing 120 by using a crimping tool 200, and the crimp connection work includes the following steps:

(1) first, stripping the cable 110, which is removing a plastic coating 140 of an end of the cable 110 to expose a plurality wires 130 in the interior thereof;

(2) subsequently, performing wire trimming, which is after each wires 130 exposed on an end of the cable 110 is straightened and clarified, further smoothly trimming the wires 130 and reserving an exposed part of a proper length;

(3) then, penetrating the cable 110 into a passage of the connector housing 120, and placing each wires 130 of the cable 110 separately in a wire groove of the connector housing 120 in a penetrating manner; and (4) performing a crimp connection by using the crimping tool 200 to firmly connect the cable 110 and the connector housing 120.

Upon researches, the connector housing 120 and the crimping tool 200 still have the following disadvantages during crimp connection work:

(1) Because a passage of the connector housing 120 is a closed wire groove extending toward a front end, it is necessary to first smoothly trim an end portion of each wires 130, so as to place each wires 130 at a correct crimp connection position in a penetrating manner, and if the wires 130 is not smoothly trimmed in advance, it is impossible to place all of the wires 130 at correct crimp connection positions in a penetrating manner.

(2) Because a passage of the connector housing 120 is a closed wire groove extending toward a front end, before a penetrating step is performed, it is necessary to first smoothly trim an end portion of each wires 130 and reserve an exposed part of a proper length; however, if the reserved part of the wires 130 is extremely short, it is difficult for a conduction element to get in contact with the wires 130, and if the reserved part of the wires 130 is extremely long, a crimping block of the connector housing 120 only engages against the sires 130 instead of abutting against the plastic coating 140 of the cable 110, and it would cause the connector housing 120 being easily fallen off the cable 110.

(3) An end portion of each wires 130 is smoothly trimmed and an exposed part of a proper length is reserved, and further, after the penetrating step, visual inspection is performed to check whether the cable 110 penetrates into a correct crimp connection position; however, it is difficult to ensure smoothness of each wires 130 in a visual inspection manner, and because the wires 130 and the wire groove of the connector housing 120 are quite small, it is difficult to clearly visually inspect whether each wires 130 penetrates into a correct crimp connection position.

SUMMARY OF THE INVENTION

In view of the foregoing disadvantages in the prior art, the present invention provides novel terminal connector pliers that can smoothly trim wires of a cable while performing a crimping connection.

The present invention relates to a terminal connector pliers, where the terminal connector pliers crimp a cable to a connector housing, and the terminal connector pliers include:

a main body, where the main body is provided with a through-hole, a placement position of the connector housing is disposed inside the through-hole, and a guide groove is disposed near the placement position; and a first linking body and a second linking body, where the first linking body and the second linking body are pivoted to the main body by a first pivot, the first linking body is pivoted to a third linking body, the second linking body is pivoted to a fourth linking body, the third linking body and the fourth linking body are pivoted a crimping block by using a second pivot, the crimping block is disposed inside the guide groove, and a movement track of the crimping block is guided by the guide groove; and a first primary knife, disposed near an outer edge of the through-hole, and a first secondary knife, opposite to the first primary knife, disposed on the crimping block, where a movement track of the first secondary knife is guided by movement of the crimping block.

Hence, the following steps are performed:

(1) Firstly, the cable is stripped, which is removing a plastic coating of an end of the cable to expose wires in the interior thereof, and when the cable is placed into the connector housing, the connector housing is placed at the placement position, and the wires penetrate out of the through-hole.

(2) When the first linking body and the second linking body are closed in a crimping manner, the third linking body and the fourth linking body are actuated to move.

(3) The third linking body and the fourth linking body actuate the crimping block to move toward the placement position, so that while the connector housing and the cable are connected in a crimping manner, and because the first secondary knife, opposite to the first primary knife, is disposed on the crimping block, a movement track of the first secondary knife is guided by movement of the crimping block, the first primary knife and the first secondary knife smoothly trim the wires that penetrate out of the through-hole. (Such a trimming manner does not need to involve measuring a trimming length of the wires in advance, but can ensure that a length of the wires reserved in the connector housing is enough.)

Further, the first primary knife is screwed to the main body by using a bolt, and a first cutter and a second cutter are disposed on the first primary knife, so that when it is necessary to cut off signal wires of different specifications, the bolt can be loosened to change to the first cutter or the second cutter, so as to use the first cutter or the second cutter to perform cutting.

Further, the first linking body is provided with a second primary knife, a second secondary knife, opposite to the second primary knife, is disposed on the second linking body, and when the first linking body and the second linking body are closed in a pressing manner, there is still a proper gap between the second primary knife and the second secondary knife, so that the second primary knife and second secondary knife only cut off a plastic coating outside the wires instead of cutting off the wires.

Further, the first linking body is provided with a second primary knife, a second secondary knife, opposite to the second primary knife, is disposed on the second linking body, and when the first linking body and the second linking body are closed in a pressing manner, the second primary knife and the second secondary knife smoothly trim the cable between the second primary knife and the second secondary knife.

Further, an end of a first return spring is hooked to the first linking body, and the other end of the first return spring is hooked to the main body.

Further a rotatable bump is disposed on the second linking body, an end of a second return spring is hooked to the rotatable bump, the other end of the second return spring is hooked to the second linking body, a ratchet block is disposed on the first linking body, the ratchet block is provided with a plurality of ratchet teeth, some of the plurality of ratchet teeth have a relatively large tooth gap, a position between the first linking body and the second linking body can be fixed by engaging the ratchet teeth with the rotatable bump, and it is only needed to rotate the rotatable bump to make the rotatable bump fall within a space with a relatively large tooth gap, so that the ratchet teeth can be disengaged from the rotatable bump to release engagement between the first linking body and the second linking body.

The present invention involves smoothly trimming a wire core of a signal wire that penetrate out of a through-hole while performing a crimp connection. The present invention apparently has industrial applicability, novelty, and inventiveness, and the present invention meets patentability requirements.

DESCRIPTION OF THE EMBODIMENTS

Implementation manners of the present invention are explained below by using specific embodiments, and it would be easy for those skilled in the art to understand other advantages and effects of the present invention according to the disclosure of the present description. The present invention may also be implemented or applied in other specific different implementation manners. Details of the present description may also be modified or changed on the basis of different opinions and application without departing from the spirit of the present invention.

Figure 1:
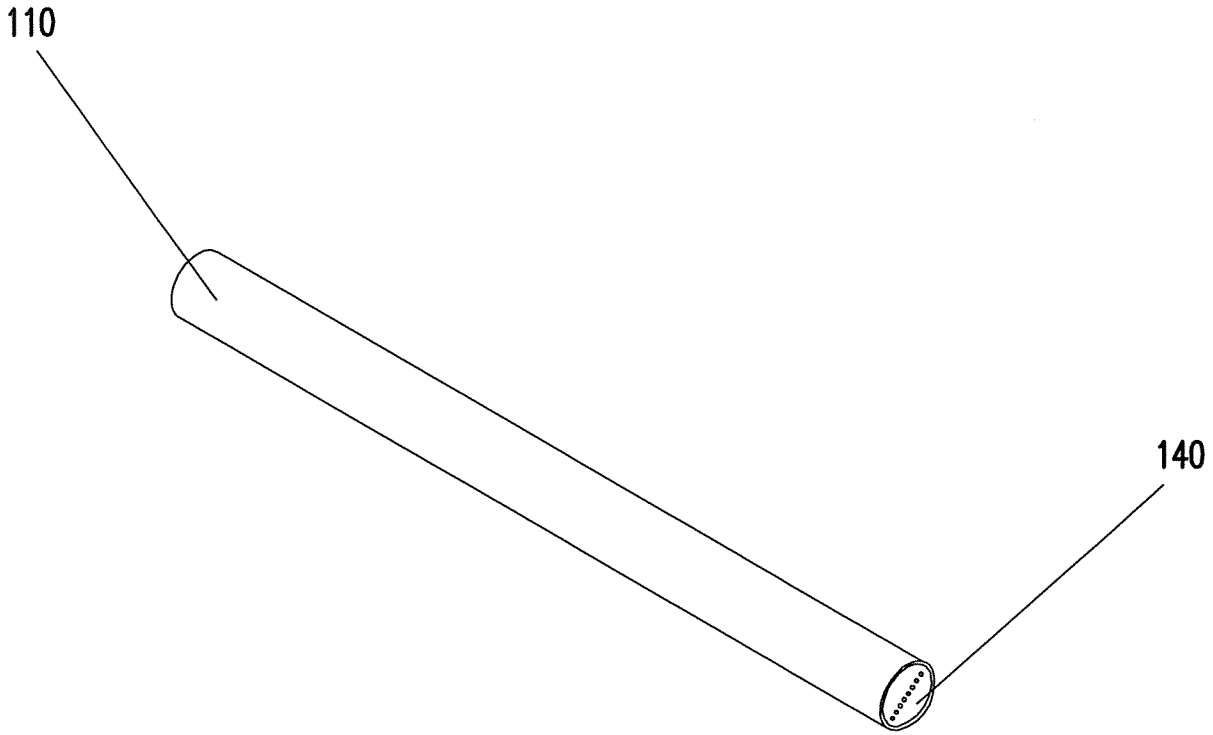
FIG. 1 (PRIOR ART)
FIG. 1 is a schematic diagram of a conventional cable.
Figure 2:
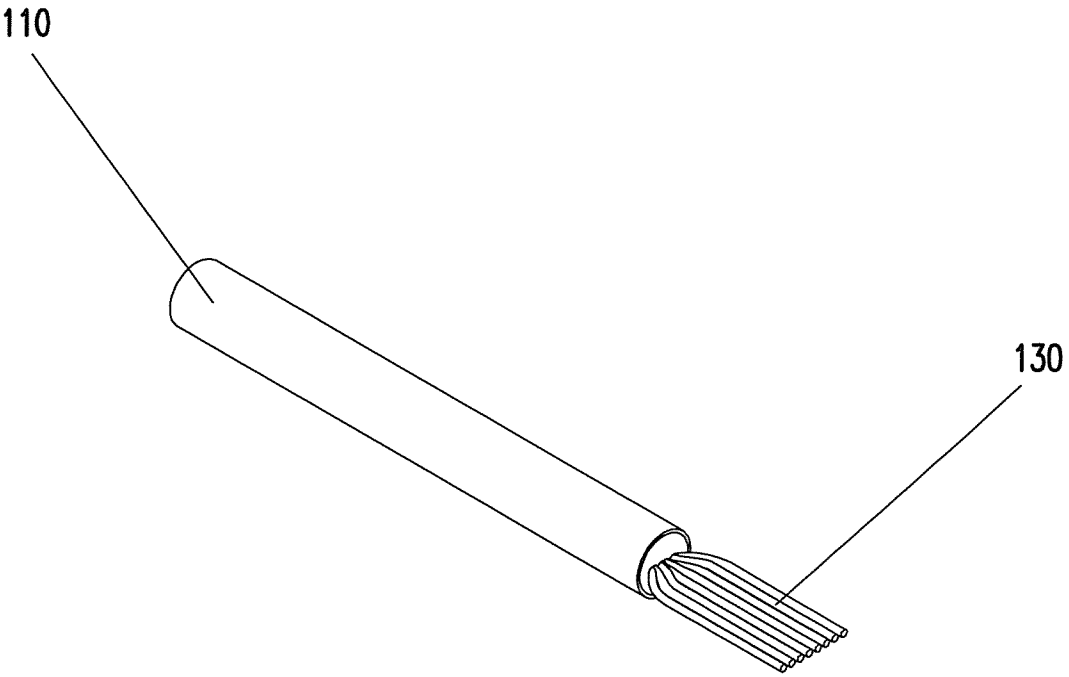
FIG. 2 (PRIOR ART)
FIG. 2 is a schematic diagram of exposed wires after a conventional cable is stripped.
Figure 3:
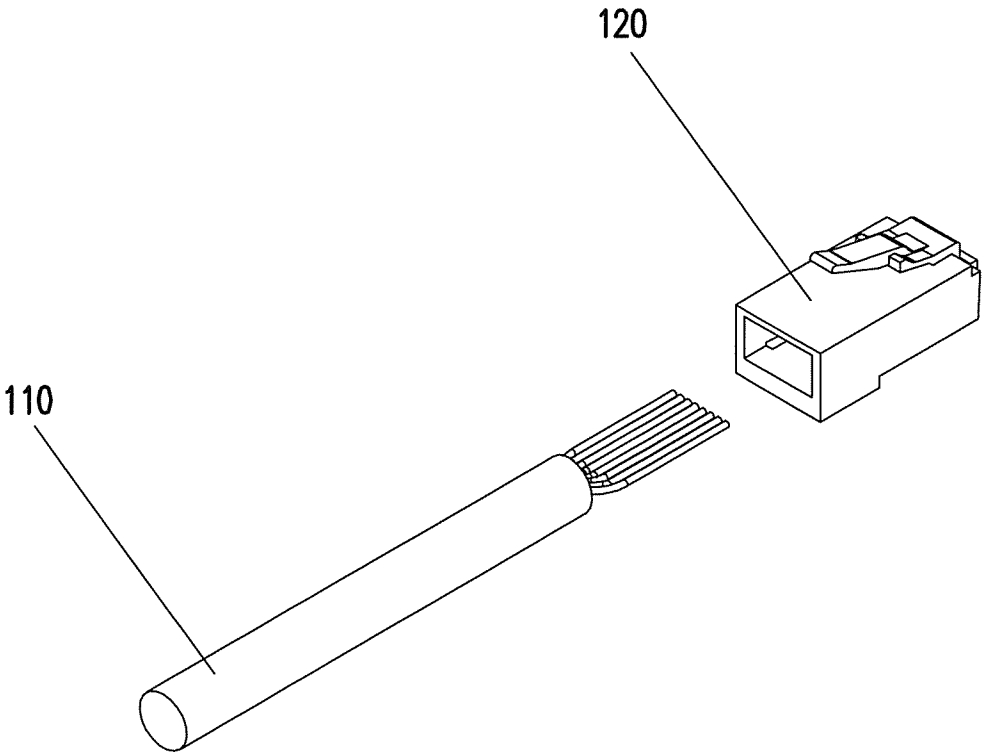
FIG. 3 (PRIOR ART)
FIG. 3 is a schematic assembly diagram of a conventional cable and a connector housing.
Figure 4:
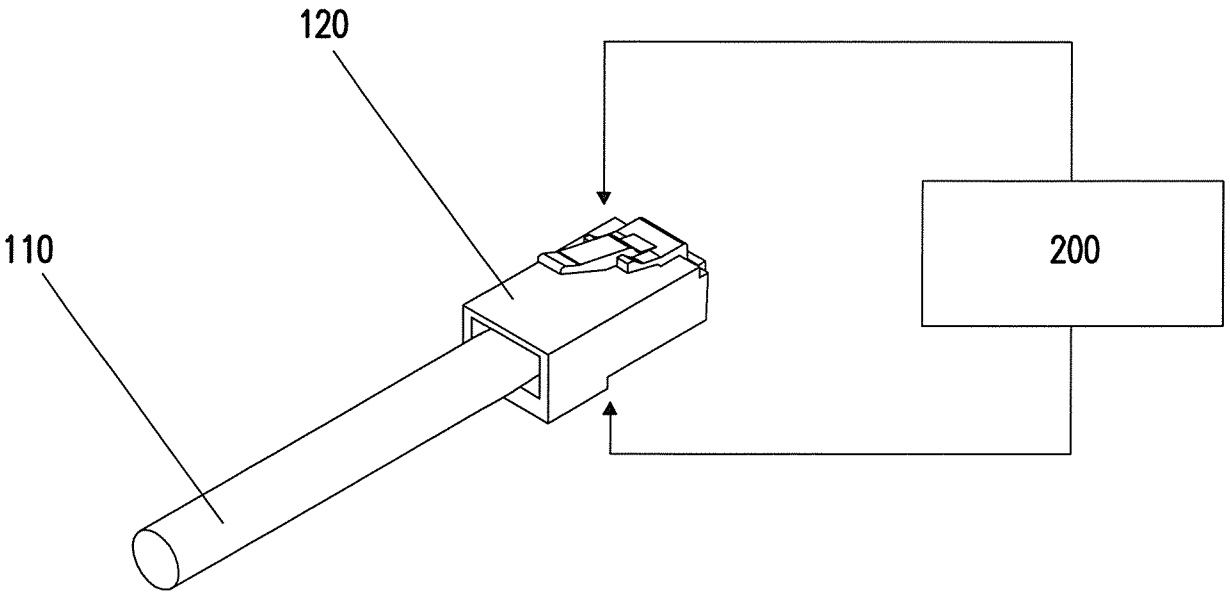
FIG. 4 (PRIOR ART)
FIG. 4 is a schematic diagram illustrating a crimp connection between a conventional cable and a connector housing.
Figure 5:
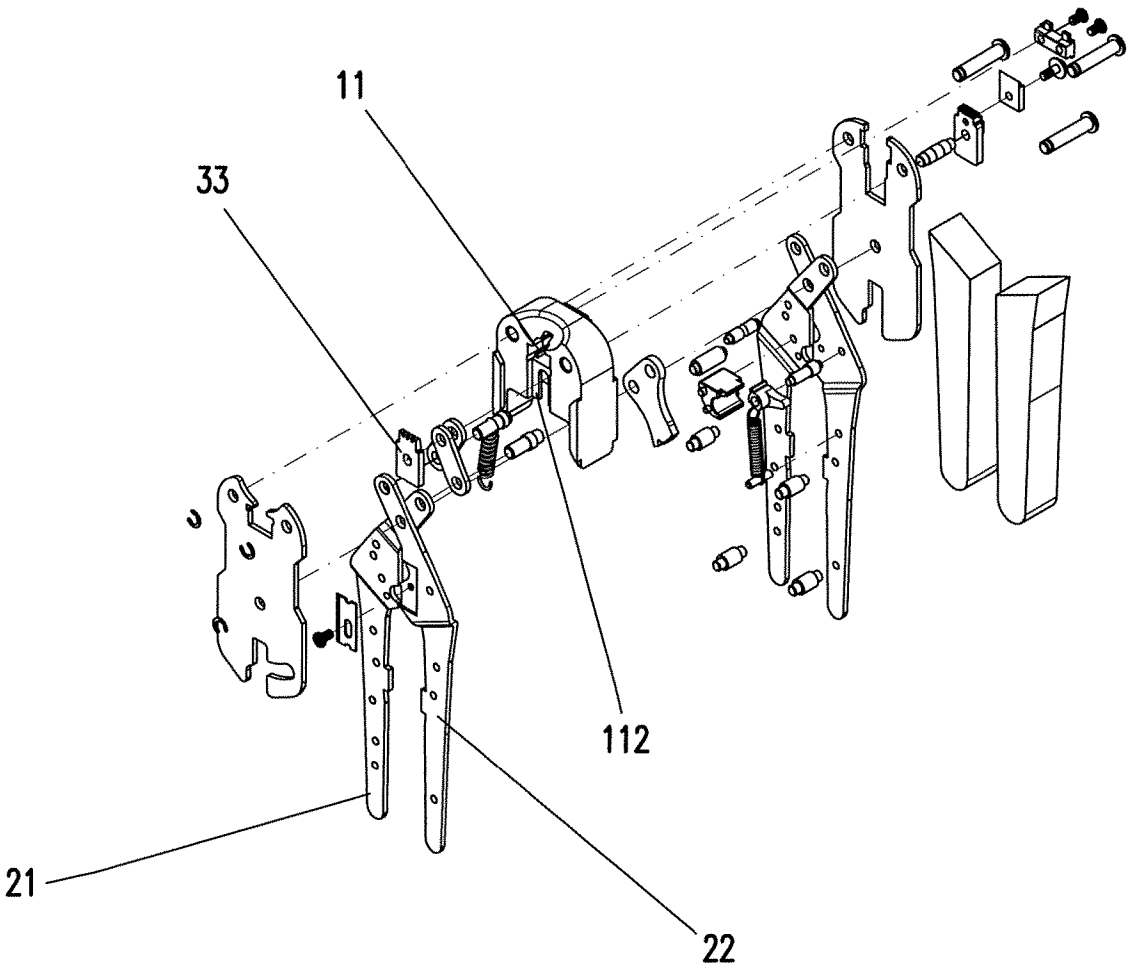
FIG. 5 is an exploded view of terminal connector pliers according to the present invention.
Figure 6:
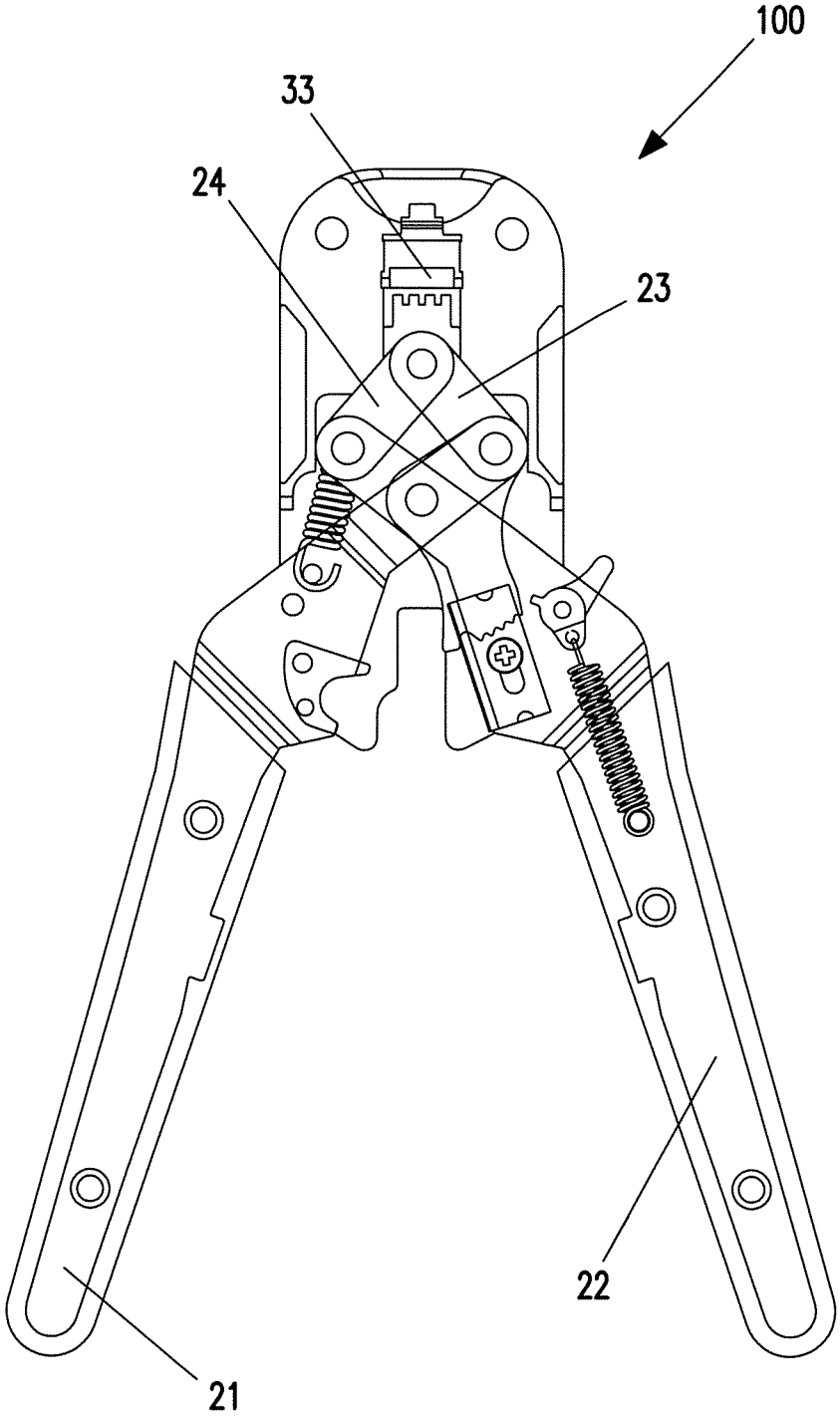
FIG. 6 is a sectional view of terminal connector pliers according to the present invention.
Figure 7:
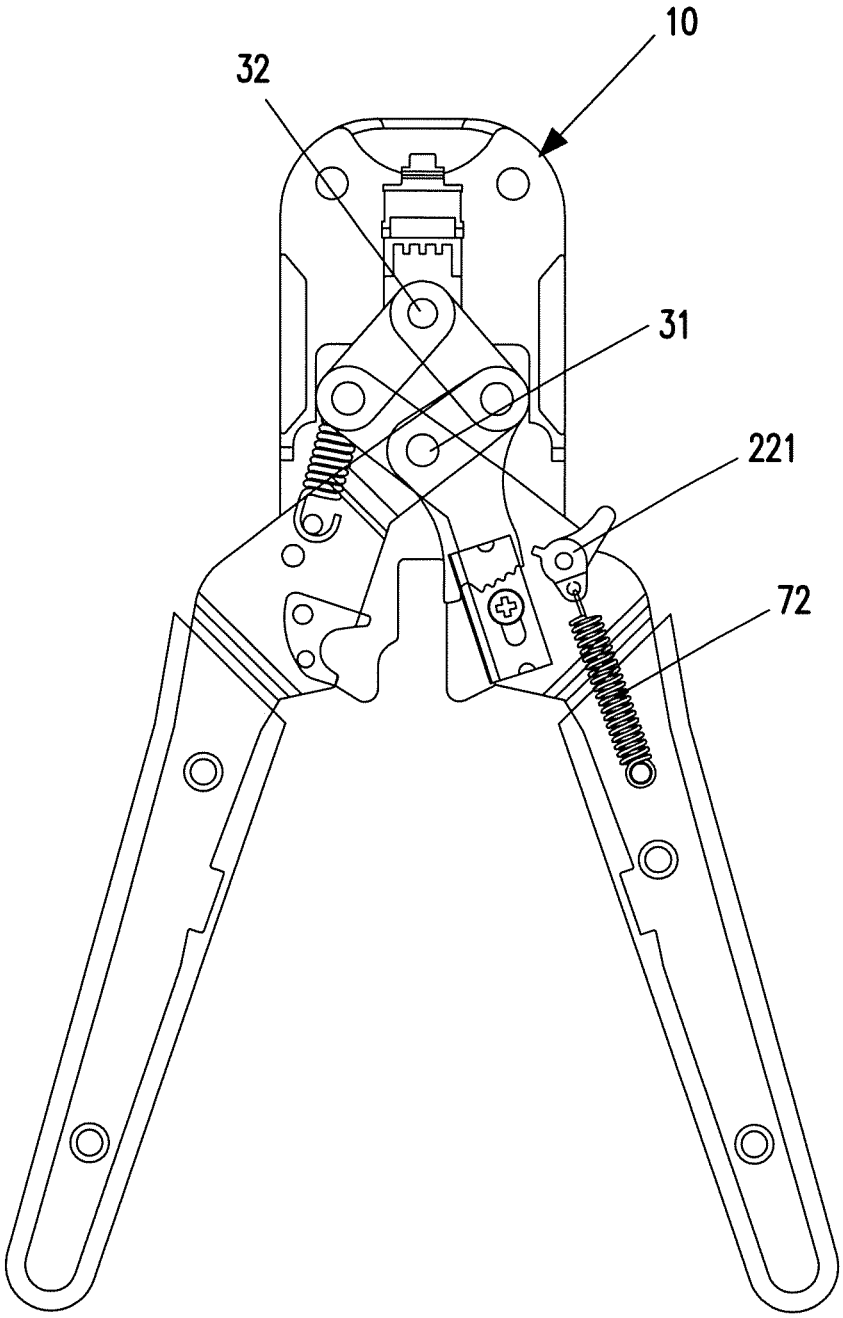
FIG. 7 is a sectional view of terminal connector pliers according to the present invention.
Figure 8:
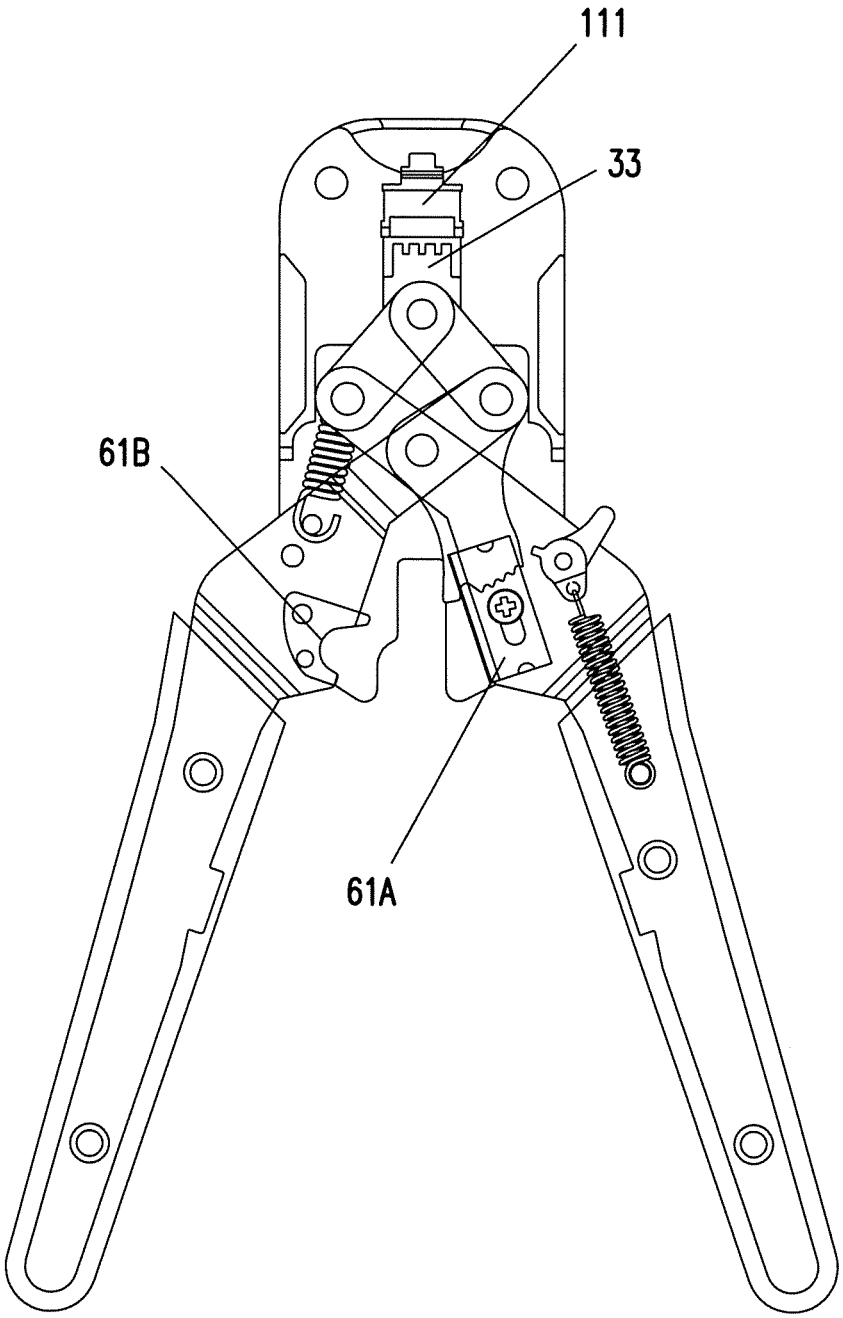
FIG. 8 is a sectional view of terminal connector pliers according to the present invention.
Figure 9:
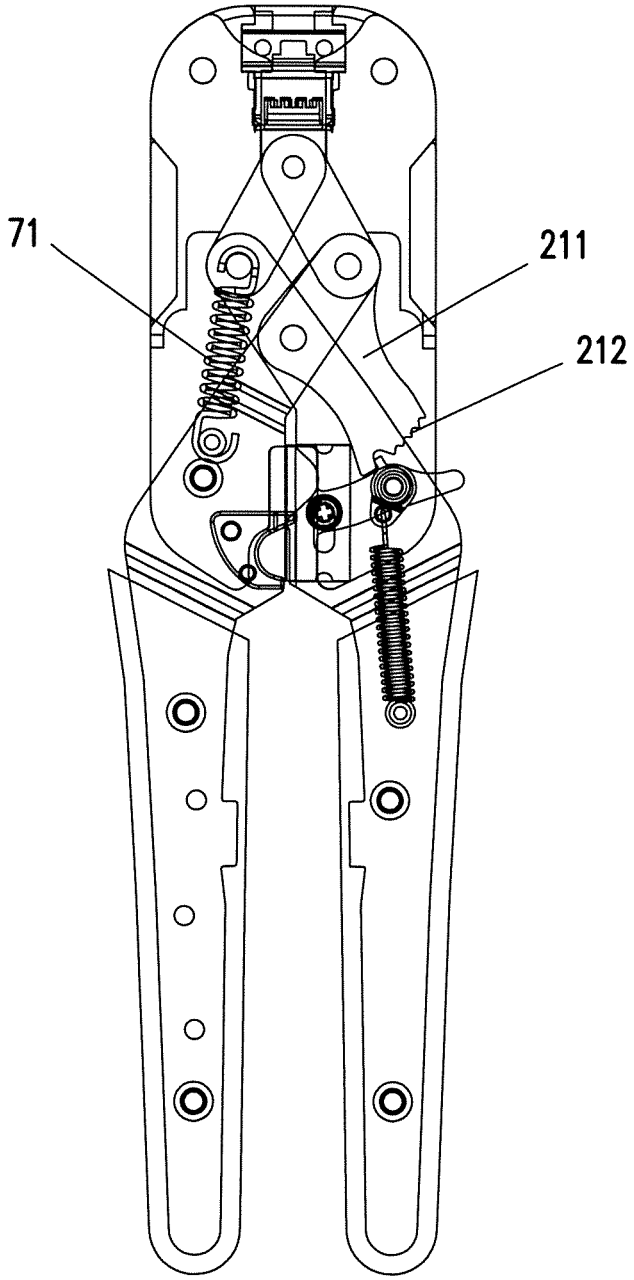
FIG. 9 is a sectional view of terminal connector pliers according to the present invention.
Figure 10:
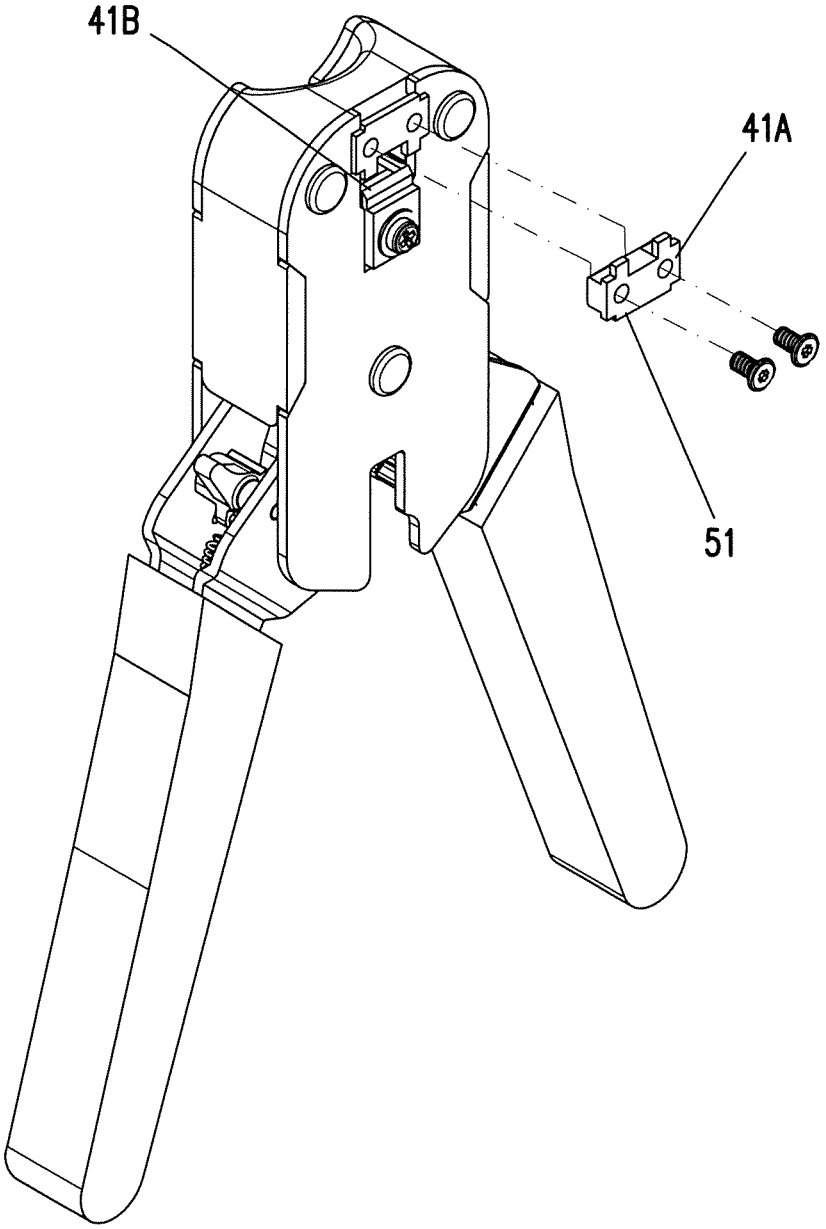
FIG. 10 is a schematic assembly diagram of screwing a first primary knife to a main body by using a bolt according to the present invention.
Figure 11:
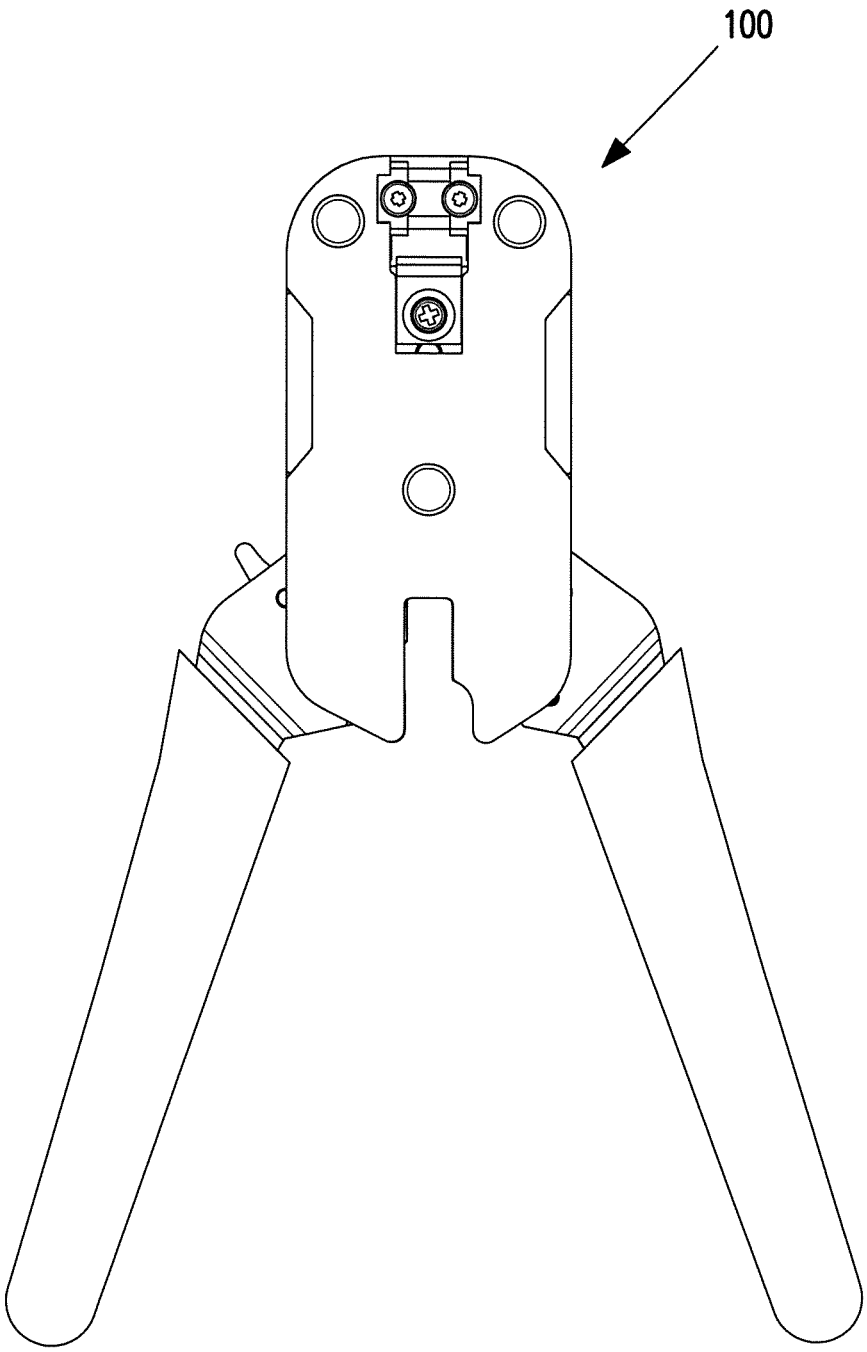
FIG. 11 is a schematic diagram of screwing a second primary knife to a main body by using a bolt according to the present invention.
Figure 12:
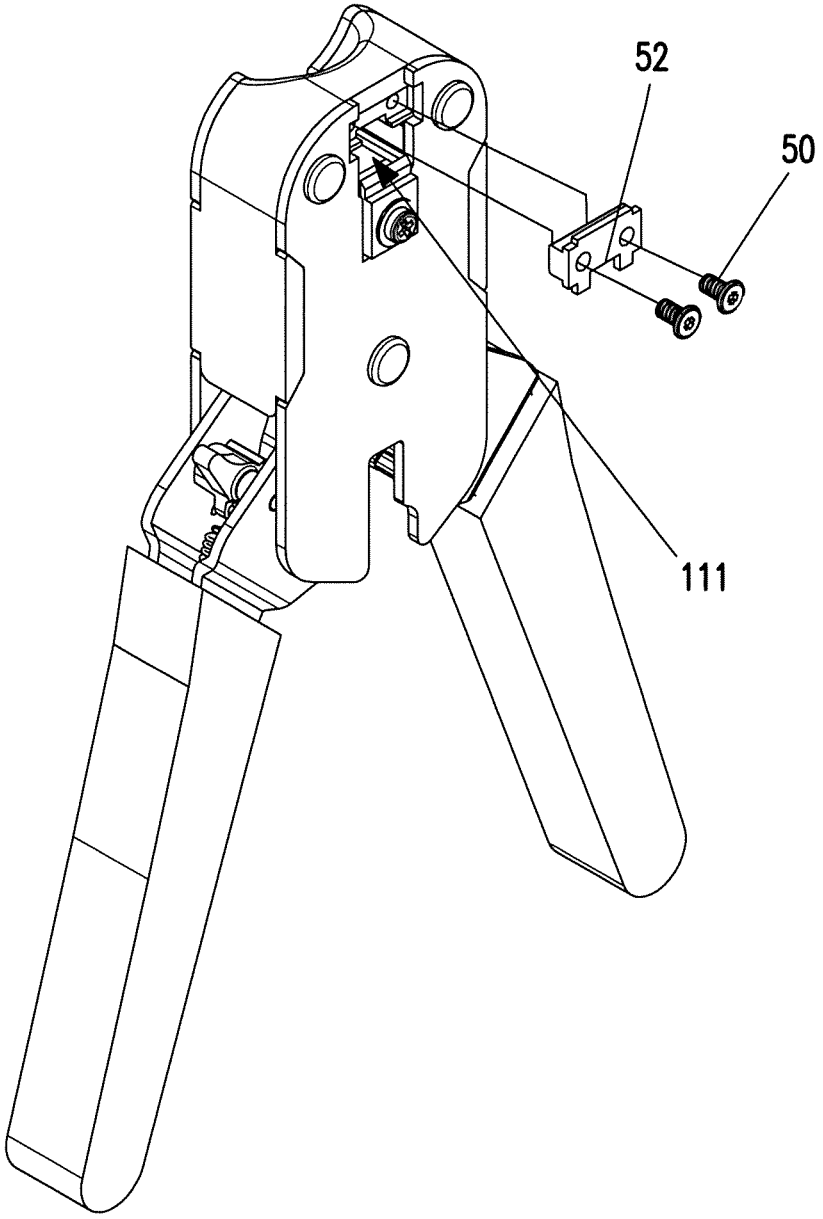
FIG. 12 is a schematic assembly diagram of screwing a second primary knife to a main body by using a bolt according to the present invention.
Figure 13:
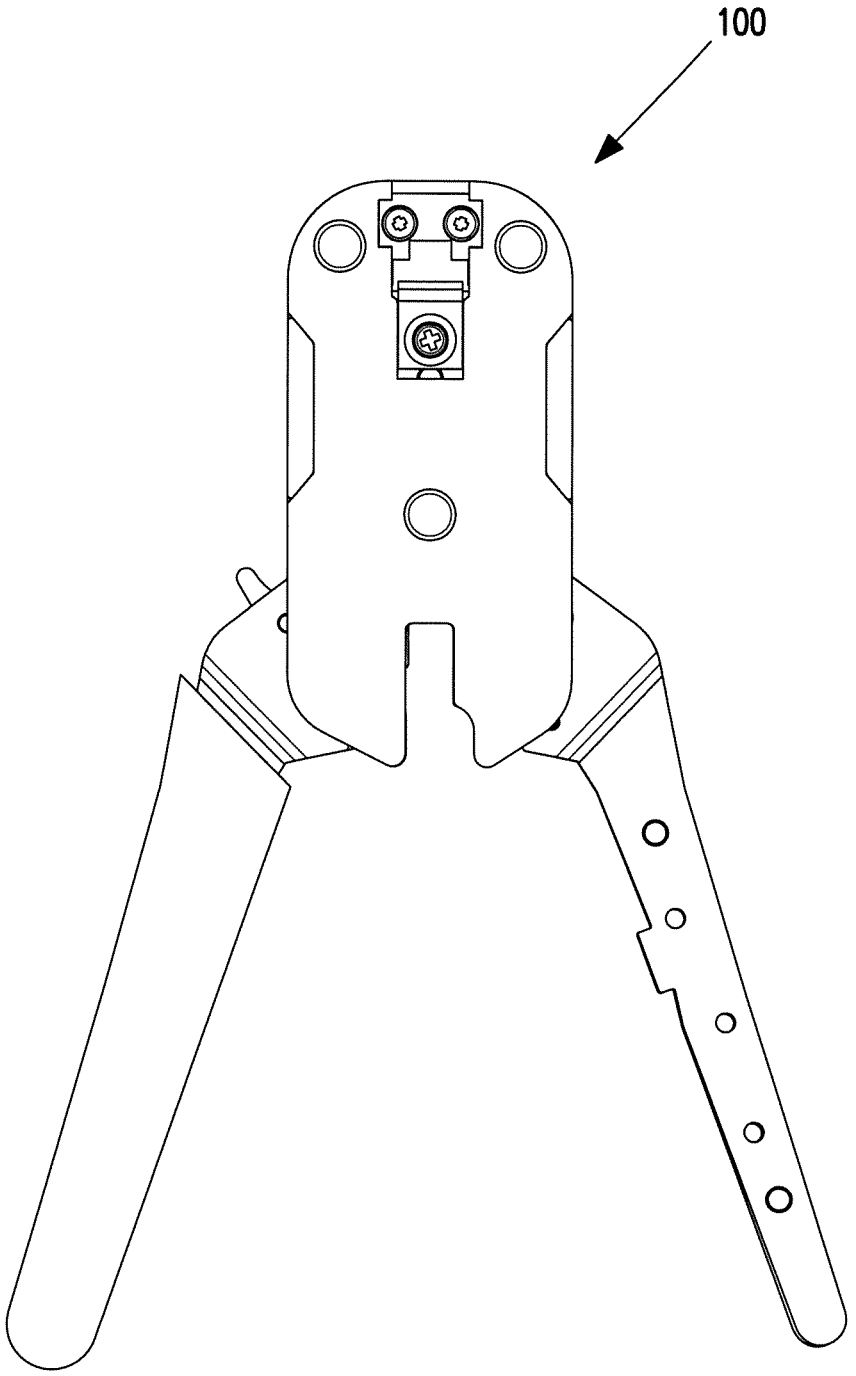
FIG. 13 is a schematic diagram of screwing a second primary knife to a main body by using a bolt according to the present invention.

As disclosed in FIG. 5 to FIG. 20:

FIG. 5 is an exploded view of terminal connector pliers 100 according to the present invention.

FIG. 6 to FIG. 9 are sectional views of the terminal connector pliers 100 according to present invention and disclose a connection relationship between components;

FIG. 10 to FIG. 13 are schematic diagrams of screwing a first primary knife 41A to a main body 10 by using a bolt 50 according to the present invention and disclose the first primary knife 41A including a first cutter 51 and a second cutter 52 and an assembly manner of the first cutter 51 and the second cutter 52.

Figure 14:
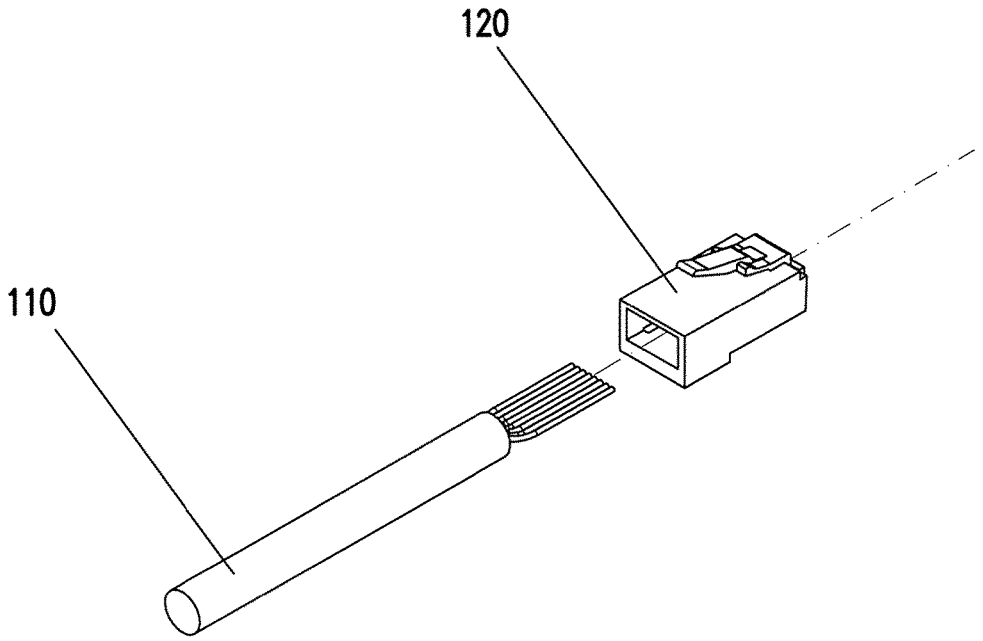
FIG. 14 is a schematic assembly diagram of a cable and a connector housing according to present invention.
Figure 15:
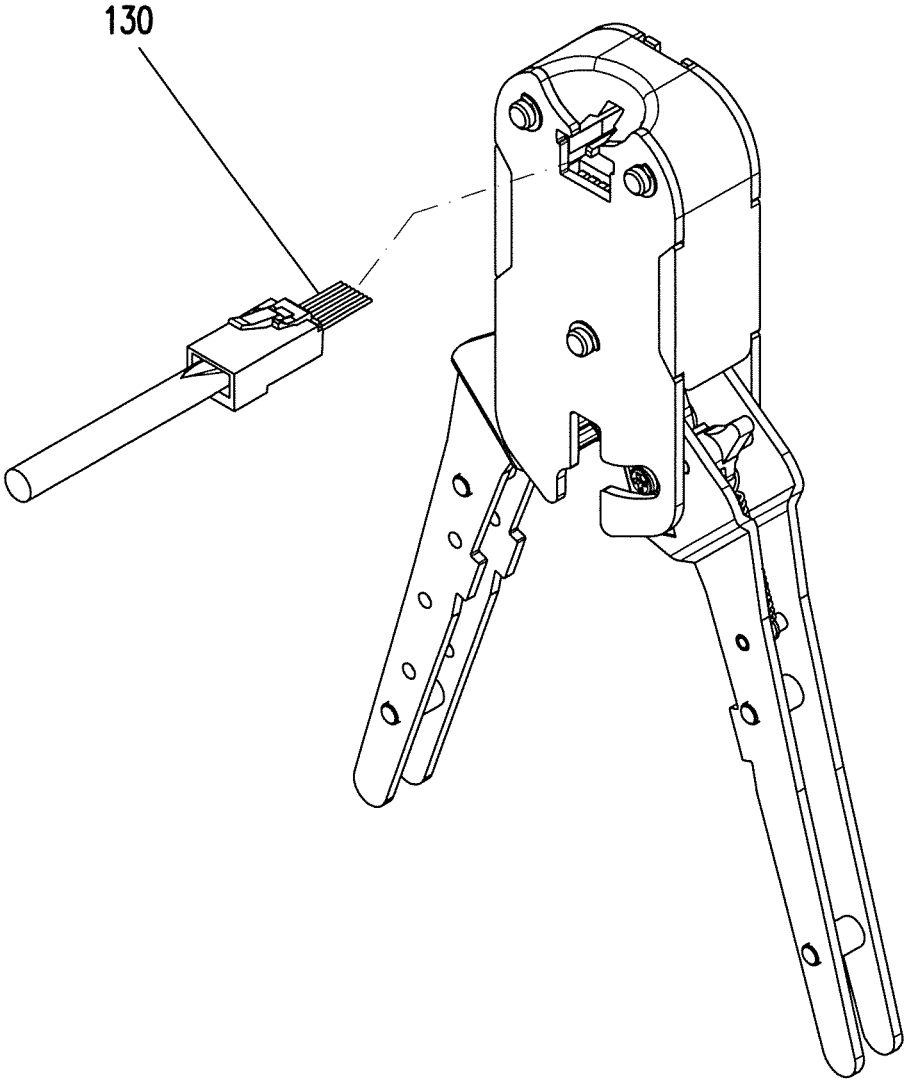
FIG. 15 is a schematic assembly diagram of signal terminal crimping pliers and a connector housing according to present invention.
Figure 16:
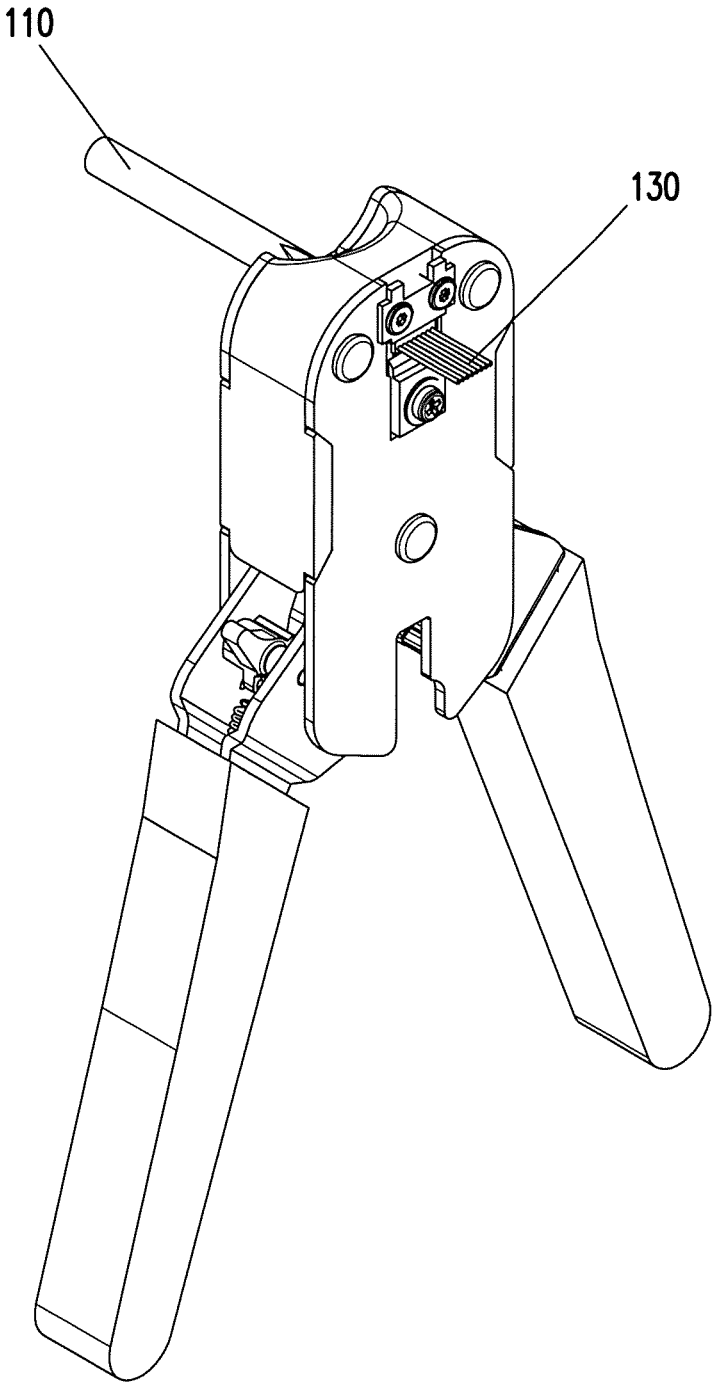
FIG. 16 is a schematic diagram of placing a connector housing into signal terminal crimping pliers and exposing a plurality wires out of a through-hole according to present invention.
Figure 17:
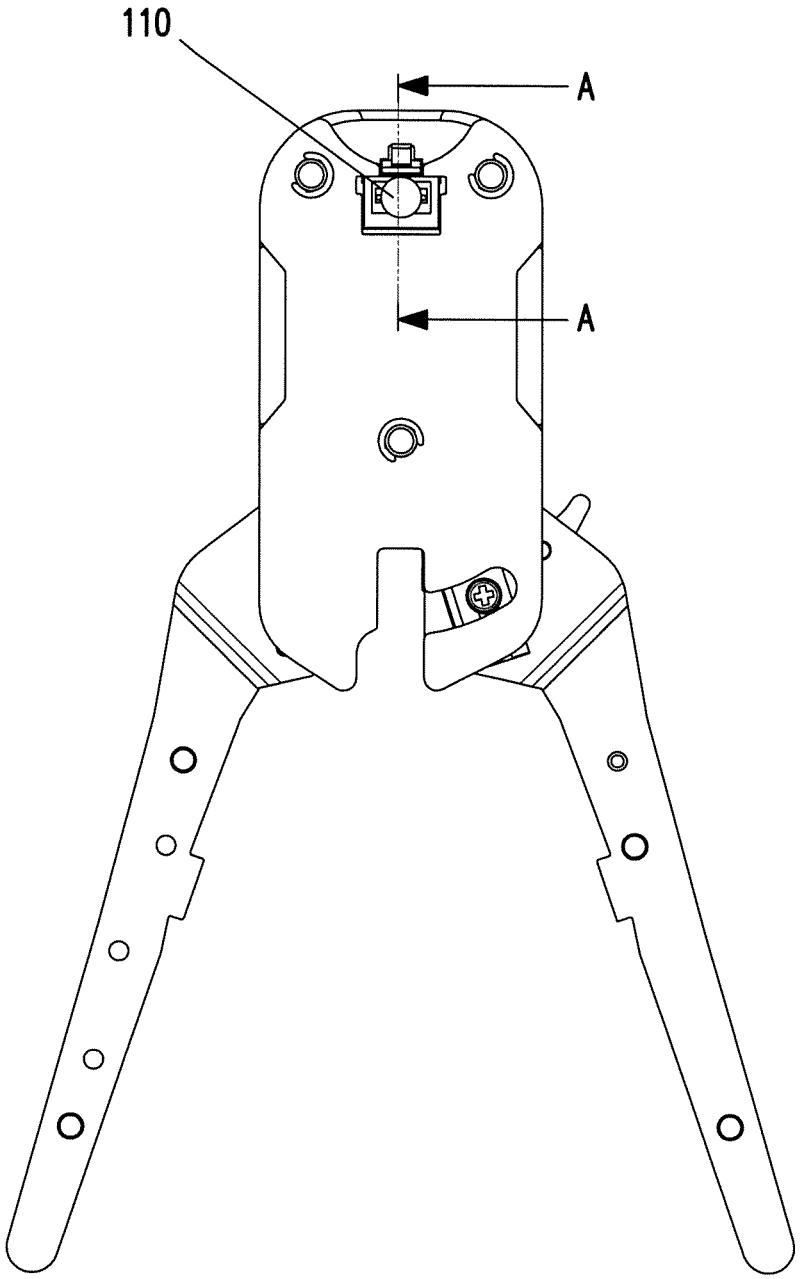
FIG. 17 is a schematic diagram of opening signal terminal crimping pliers, placing a connector housing into a placement position, and placing a cable into the connector housing according to present invention.
Figure 18:
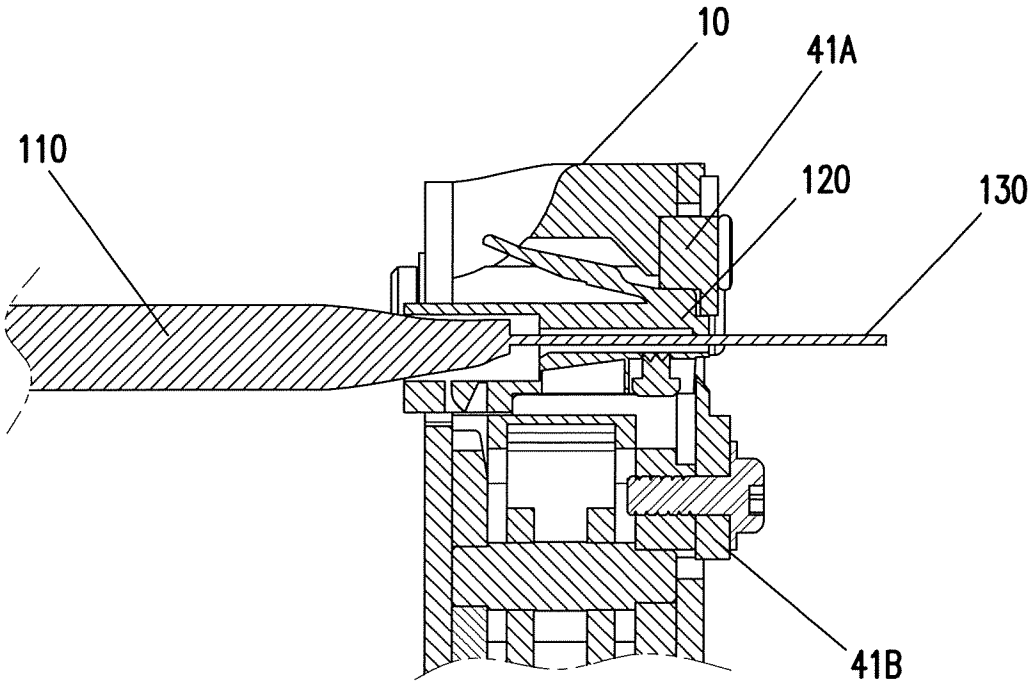
FIG. 18 is an AA sectional view of FIG. 17 and discloses that a wire is not trimmed.
Figure 19:
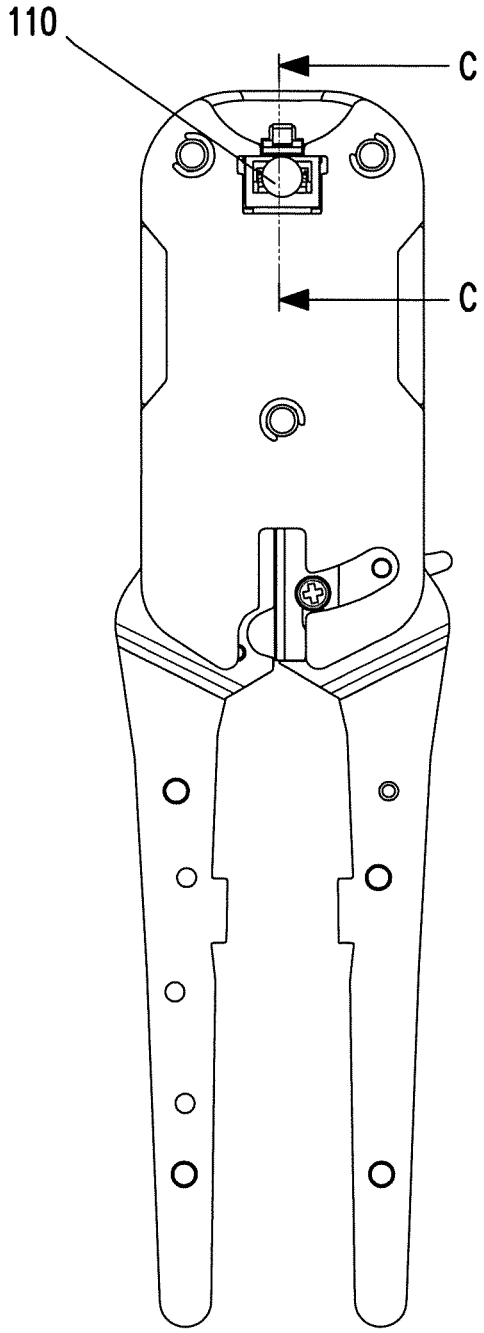
FIG. 19 is a schematic diagram of closing signal terminal crimping pliers in a pressing manner and smoothly trimming a wire of a cable according to present invention.
Figure 20:
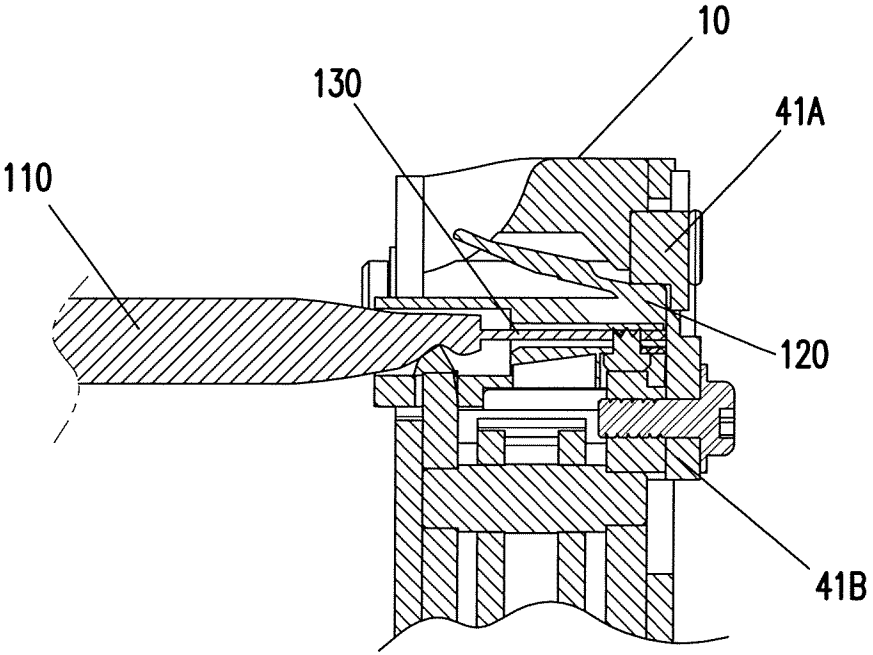
FIG. 20 is a CC sectional view of FIG. 19 and discloses that wires are smoothly trimmed.

FIG. 14 to FIG. 16 are schematic diagrams of placing a connector housing 120 into the signal terminal crimping pliers 100 and exposing wires 130 out of a through-hole 11 according to present invention.

FIG. 17 to FIG. 20 are schematic diagrams of after placing the connector housing 120 into the signal terminal crimping pliers 100, performing a crimp connection and smoothly trimming the wires 130 according to present invention.

As disclosed in FIG. 5 to FIG. 20, the present invention relates to terminal connector pliers 100, where the terminal connector pliers 100 connect a cable 110 to a signal terminal connector 120 in a crimping manner, and the terminal connector pliers 100 include:

a main body 10, where the main body 10 is provided with a through-hole 11, a placement position 111 of the signal terminal connector 120 is disposed inside the through-hole 11, and a guide groove 112, which, for example, is a guide protrusion 112*a*, a guide groove 112*b*, a guide plane 112*c*, or a combination of at least two of them, is disposed near the placement position 111;

a first linking body 21 and a second linking body 22, where the first linking body 21 and the second linking body 22 are pivoted to the main body 10 by using a first pivot 31, the first linking body 21 is pivoted to a third linking body 23, the second linking body 22 is pivoted to a fourth linking body 24, the third linking body 23 and the fourth linking body 24 are pivoted to a crimping block 33 by using a second pivot 32, the crimping block 33 is disposed inside the guide groove 112*b*, and a movement track of the crimping block 33 is guided by the guide groove 112*b*; in addition, the first pivot 31 is parallel to the second pivot 32, where two opposite ends of the third linking body 23 are essentially pivoted to the first linking body 21 and the second pivot 32 respectively, and two opposite ends of the fourth linking body 24 are essentially pivoted to the second linking body 22 and the second pivot 32 respectively; and in other words, any structure that has an effect of guiding the crimping block 33 inside the main body 10 is the guide structure 112 of this embodiment. Herein, an axial direction of a crimp connection performed by the crimping block 33 on the connector housing 120, the cable 110, and the wires 130 thereof is parallel to a plane on which the first linking body 21 and the second linking body 22 (or the third linking body 23 and the fourth linking body 24) are located, that is, being orthogonal to the first pivot 31 and the second pivot 32.

In this embodiment, the terminal connector pliers 100 further include a cutting mechanism CT, disposed near an outer edge of the through-hole 11 and linked to the crimping block 33. After wires 130 of the cable 110 penetrate through the connector housing 120 and are placed into the placement position 111, parts 132 of the wires 130 penetrate out of the main body 10, so that when the crimping block 33 is moved into the through-hole 11, the cutting mechanism CT moves along with the crimping block 33 to cut out the parts 132 of the wires 130, so as to make remaining parts of the wires 130 flush (and align) with the connector housing 120. The cutting mechanism CT includes a first primary knife 41A and a first secondary knife 41B opposite to each other, and one of the first primary knife 41A and the first secondary knife 41B is assembled on the main body 10, and the other of the first primary knife 41A and the first secondary knife 41B is assembled on the crimping block 33. Specifically, the first primary knife 41A is disposed near an outer edge of the through-hole 11, and the first secondary knife 41B, opposite to the first primary knife 41A, is disposed on the crimping block 33, where a movement track of the first secondary knife 41B is guided by movement of the crimping block 33.

Hence, the following steps are performed:

(1) The cable 110 is first stripped, which is removing a plastic coating 140 of an end of the cable 110 to expose the wires 130 in the interior thereof, and when the cable 110 is placed into the connector housing 120, the connector housing 120 is placed at the placement position 111, and the wires 130 penetrate out of the through-hole 11.

(2) When the first linking body 21 and the second linking body 22 are closed in a pressing (crimping) manner, the third linking body 23 and the fourth linking body 24 are actuated to move.

(3) The third linking body 23 and the fourth linking body 24 actuate the crimping block 33 to move toward the placement position 111, so that while the connector housing 120 and the cable 110 are connected in a crimping manner, because the first secondary knife 41B, opposite to the first primary knife 41A, is disposed on the crimping block 33, and a movement track of the first secondary knife 41B is guided by movement of the crimping block 33, the first primary knife 41A and the first secondary knife 41B smoothly trim the wires 130 that penetrates out of the through-hole 11. (Such a trimming manner does not need to involve measuring a trimming length of the wires 130 in advance, but can ensure that a length of the wires 130 reserved in the connector housing 120 is enough.) Moreover, in another embodiment that is not shown, the first primary knife may also be disposed on the crimping block 33 to move together with the crimping block 33, and the first secondary knife may also be disposed on the main body 10.

Further, the first primary knife 41A is screwed to the main body 10 by using a bolt 50, and a first cutter 51 and a second cutter 52 are disposed on the first primary knife 41A, so that when it is necessary to cut off cable 110 of different specifications, the bolt 50 can be loosened to change to the first cutter 51 or the second cutter 52, so as to use the first cutter 51 or the second cutter 52 to perform cutting.

Further, the first linking body 21 is provided with a second primary knife 61A, a second secondary knife 61B, opposite to the second primary knife 61A, is disposed on the second linking body 22, and when the first linking body 21 and the second linking body 22 are closed in a pressing manner, there is still a proper gap between the second primary knife 61A and the second secondary knife 61B, so that the second primary knife 61A and second secondary knife 61B only cut off the plastic coating 140 outside the cable 110 instead of cutting off the wires 130 of the cable 110.

Further, the first linking body 21 is provided with a second primary knife 61A, a second secondary knife 61B, opposite to the second primary knife 61A, is disposed on the second linking body 22, and when the first linking body 21 and the second linking body 22 are closed in a pressing manner, the second primary knife 61A and the second secondary knife 61B smoothly trim the cable 110 between the second primary knife 61A and the second secondary knife 61B.

Further, an end of a first return spring 71 is hooked to the first linking body 21, and the other end of the first return spring 71 is hooked to the main body 10.

Further a rotatable bump 221 is disposed on the second linking body 22, an end of a second return spring 72 is hooked to the rotatable bump 221, the other end of the second return spring 72 is hooked to the second linking body 22, a ratchet block 211 is disposed on the first linking body 21, the ratchet block 211 is provided with a plurality of ratchet teeth 212, some of the plurality of ratchet teeth 212 have a relatively large tooth gap, a position between the first linking body 21 and the second linking body 22 can be fixed by engaging the ratchet teeth 212 with the rotatable bump 221, and it is only needed to rotate the rotatable bump 221 to make the rotatable bump 221 fall within a space with the relatively large tooth gap, so that the ratchet teeth 212 can be disengaged from the rotatable bump 221 to release engagement between the first linking body 21 and the second linking body 22.

The foregoing embodiments merely illustratively describe principles of the present invention and effects thereof and are not used to limit the present invention. Those skilled in the art could make modifications and changes to the foregoing embodiments without departing from the spirit and scope of the present invention. Therefore, any equivalent modifications or changes made by those of ordinary skill in the art without departing from the spirit and technical concept disclosed by the present invention shall still be covered by the claims of the present invention.

What is claimed is:

1. A terminal connector pliers, used for crimping a cable to a connector housing to form a terminal connector, comprising:

a main body, having a through-hole, wherein a placement position of the connector housing is disposed inside the through-hole, and a guide structure is disposed near the placement position;

a first linking body and a second linking body, pivoted to the main body via a first pivot, wherein the first linking body is pivoted to a third linking body, the second linking body is pivoted to a fourth linking body, the third linking body and the fourth linking body are pivoted to a crimping block via a second pivot, and a movement track of the crimping block is guided by the guide structure to move the crimping block into or out of the through-hole, wherein when a plurality of wires of the cable penetrate through the connector housing and are placed into the placement position, the first linking body and the second linking body are forced to drive the third linking body and the fourth linking body, so as to move the crimping block into the through-hole to crimp the wires to the connector housing; and a cutting mechanism, disposed near an outer edge of the through-hole and linked to the crimping block, wherein after the wires of the cable penetrate through the connector housing and are placed into the placement position, parts of the wires penetrate out of the main body, so that when the crimping block is moved into the through-hole, the cutting mechanism moves along with the crimping block to cut out the parts of the wires, so as to make remaining parts of the wires flush with the connector housing, wherein the cutting mechanism comprises a first primary knife and a first secondary knife opposite to each other, and one of the first primary knife and the first secondary knife is assembled on the main body, and the other of the first primary knife and the first secondary knife is assembled on the crimping block, wherein an end of a first return spring is hooked to the first linking body, and the other end of the first return spring is hooked to the main body, wherein a rotatable bump is disposed on the second linking body, an end of a second return spring is hooked to the rotatable bump, the other end of the second return spring is hooked to the second linking body, a ratchet block is disposed on the first linking body to be moved along with the first linking body, a pivoting portion of the first linking body and the third linking body is connected to the ratchet block, the ratchet block is provided with a plurality of ratchet teeth and a plurality of tooth gaps formed between every two adjacent ratchet teeth, at least one tooth gap is formed to be larger than the rest of the tooth gaps, a position between the first linking body and the second linking body can be fixed by engaging the ratchet teeth with the rotatable bump, such that the ratchet block on the first linking body disables the first linking body from actuating the third linking body pivoted thereon with rotational movement, and the rotatable bump is rotated to be fallen within a space of the at least one tooth gap that is formed to be larger, so that the ratchet teeth can be disengaged from the rotatable bump to release engagement between the first linking body and the second linking body.

2. The terminal connector pliers according to claim 1, wherein the first primary knife is screwed to the main body by a bolt, and a first cutter and a second cutter are disposed on the first primary knife, so that when it is necessary to cut off signal wires of different specifications, the bolt can be loosened to change to the first cutter or the second cutter, so as to use the first cutter or the second cutter to perform cutting.

3. The terminal connector pliers according to claim 2, wherein a second primary knife is disposed on the first linking body, a second secondary knife opposite to the second primary knife is disposed on the second linking body, and when the first linking body and the second linking body are crimping to be closed to each other, a gap existed between the second primary knife and the second secondary knife, so that the second primary knife and second secondary knife only cut off a plastic coating outside the cable instead of cutting off the wires.

4. The terminal connector pliers according to claim 2, wherein a second primary knife is disposed on the first linking body, a second secondary knife opposite to the second primary knife is disposed on the second linking body, and when the first linking body and the second linking body are crimping to be closed to each other, the second primary knife and the second secondary knife trim and align the wires between the second primary knife and the second secondary knife.

5. The terminal connector pliers according to claim 1, wherein the guide structure is a guide groove, a guide protrusion, a guide plane, or a combination of at least two of them formed in a structure of the main body.

* * * * *